United States Patent [19]

Nakajima et al.

[11] Patent Number: 4,766,870

[45] Date of Patent: Aug. 30, 1988

[54] METHOD OF AIR/FUEL RATIO CONTROL FOR INTERNAL COMBUSTION ENGINE

[75] Inventors: Toyohei Nakajima; Yasushi Okada; Toshiyuki Mieno; Nobuyuki Oono, all of Wako, Japan

[73] Assignee: Honda Giken Kogyo Kabushiki Kaisha, Tokyo, Japan

[21] Appl. No.: 43,727

[22] Filed: Apr. 29, 1987

[30] Foreign Application Priority Data

Apr. 30, 1986 [JP] Japan ..... 61-100384

[51] Int. Cl.[4] ..... F02M 51/00; F02B 3/00

[52] U.S. Cl. ..... 123/489; 123/440

[58] Field of Search ..... 123/489, 440, 480, 478

[56] References Cited

U.S. PATENT DOCUMENTS

| | | | |
|---|---|---|---|
| 4,481,929 | 11/1984 | Hasegawa | 123/489 |
| 4,483,361 | 11/1984 | Yamada et al. | 123/489 |
| 4,499,882 | 2/1985 | Saito et al. | 123/489 |
| 4,508,075 | 4/1985 | Takao et al. | 123/489 |
| 4,509,489 | 4/1985 | Hasegawa et al. | 123/489 |
| 4,517,948 | 5/1985 | Kaji et al. | 123/489 |
| 4,517,949 | 5/1985 | Ito et al. | 123/489 |
| 4,524,745 | 6/1985 | Tominari et al. | 123/489 |

*Primary Examiner*—Raymond A. Nelli

*Attorney, Agent, or Firm*—Pollock, VandeSande & Priddy

[57] ABSTRACT

A method of air/fuel ratio control for a multicylinder internal combustion engine, utilziing an oxygen concentration sensor which produces an output varying in proportion to oxygen concentration, in which compensation values are computed and stored for use in compensating errors of a basic value which controls the air/fuel ratio. While the engine is operating in a condition condition in which the deviation of a detected air/fuel ratio from a target air/fuel ratio is below a predetermined level, respective compensation values are computed and updated for the individual cylinders of the engine, with these compensation values being computed in accordance with variations in the magnitude of the detected air/fuel ratio.

6 Claims, 13 Drawing Sheets

| FIG. 3a |
| --- |
| FIG. 3b |

METHOD OF AIR/FUEL RATIO CONTROL FOR INTERNAL COMBUSTION ENGINE

BACKGROUND OF THE INVENTION

1. Field of the Invention

The present invention relates to a method of air/fuel ratio control for an internal combustion engine.

2. Description of Background Information

In order to reduce the level of exhaust gas pollutants and improve the fuel consumption, etc. of an internal combustion engine, it is known to employ an oxygen concentration sensor to detect the concentration of oxygen in the engine exhaust gas, and to execute feedback control of the air/fuel ratio of the mixture supplied to the engine such as to hold the air/fuel ratio at a target value. This feedback control is performed in accordance with an output signal from the oxygen concentration sensor.

One type of oxygen concentration sensor which can be employed for such air/fuel ratio control functions to produce an output which varies in proportion to the oxygen concentration in the engine exhaust gas. Such an oxygen concentration sensor has been disclosed for example in Japanese patent laid-open No. 52-72286, which consists of an oxygen ion-conductive solid electrolytic member formed as a flat plate having electrodes formed on two main faces, with one of these electrode faces forming part of a gas holding chamber. The gas holding chamber communicates with a gas which is to be measured, i.e. the exhaust gas, through a lead-in aperture. With such an oxygen concentration sensor, the oxygen ion-conductive solid electrolytic member and its pair of electrodes function as an oxygen pump element. By passing a flow of current between the electrodes such that the electrode within the gas holding chamber becomes a negative electrode, oxygen gas within the gas holding chamber adjacent to this negative electrode becomes ionized, and flows through the solid electrolytic member towards the positive electrode, to be thereby emitted from that face of the sensor element as gaseous oxygen. The current flow between the electrodes is a boundary current value which is unaffected by variations in the applied voltage and is proportional to the oxygen concentration within the gas under measurement. Thus, by sensing the level of this boundary current, it is possible to measure the oxygen concentration within the gas which is under measurement. However if such an oxygen concentration sensor is used to control the air/fuel ratio of the mixture supplied to an internal combustion engine, by measuring the oxygen concentration within the engine exhaust gas, it will only be possible to control the air/fuel ratio to a value which is in the lean region, relative to the stoichiometric air/fuel ratio. It is not possible to perform air/fuel ratio control to maintain a target air/fuel ratio which is set in the rich region. An oxygen concentration sensor which will provide an output signal level varying in proportion to the oxygen concentration in engine exhaust gas for both the lean region and the rich region of the air/fuel ratio has been proposed in Japanese patent laid-open No. 59-192955. This sensor consists of two oxygen ion-conductive solid electrolytic members, each formed as a flat plate, and each provided with a pair of electrodes. Two opposing electrode faces, i.e. one face of each of the solid electrolytic members, form part of a gas holding chamber which communicates with a gas under measurement, via a lead-in aperture. The other electrode of one of the solid electrolytic members faces into the atmosphere. In this oxygen concentration sensor, one of the solid electrolytic members and its pair of electrodes functions as an oxygen concentration ratio sensor cell element. The other solid electrolytic member and its pair of electrodes functions as an oxygen pump element. If the voltage which is generated between the electrodes of the oxygen concentration ratio sensor cell element is higher than a reference voltage value, then current is supplied between the electrodes of the oxygen pump element such that oxygen ions flow through the oxygen pump element towards the electrode of that element which is within the gas holding chamber. If the voltage developed between the electrodes of the sensor cell element is lower than the reference voltage value, then a current is supplied between the electrodes of the oxygen pump element such that oxygen ions flow through that element towards the oxygen pump element electrode which is on the opposite side to the gas holding chamber. In this way, a value of current flow between the electrodes of the oxygen pump element is obtained which varies substantially in proportion to the oxygen concentration of the gas under measurement, both in the rich and the lean regions of the air/fuel ratio.

When such an oxygen concentration sensor which produces an output varying substantially in proportion to oxygen concentration is used for air/fuel ratio control, then in the same way as for a prior art type oxygen concentration sensor whose output is not proportional to oxygen concentration, a basic value for air/fuel ratio control is established in accordance with engine operating parameters relating to engine load (e.g. the pressure within the intake pipe, etc.). Compensation of the basic value with respect to a target air/fuel ratio is performed in accordance with the output from the oxygen concentration sensor, to thereby derive an output value; and the air/fuel ratio of the mixture supplied to the engine is controlled by this output value.

However normally when such an oxygen concentration sensor is employed, which produces an output varying in proportion to oxygen concentration, variations in the detector characteristic of the sensor will occur as time elapses, as well as deterioration of the sensor. As a result, the accuracy of correspondence between basic value which is set by using the oxygen concentration sensor and a target air/fuel ratio will be reduced, so that errors will arise. One method which could be envisaged to counteract this is to compute compensation values for compensating errors in the basic value, in addition to the output from the oxygen concentration sensor, and storing these compensation values as data in memory locations which are respectively determined in accordance with the specific engine operating region at the time of computing the compensation value. When computation of the output value is to be performed, in this case, the appropriate compensation value corresponding to the current operating condition of the engine would be obtained by searching the stored data, and the compensation value thus obtained used to compensate the basic value. However in the case of a multi-cylinder internal combustion engine, there will be some differences between the respective amounts of intake air supplied to the various cylinders, even if the operating conditions of all of the cylinders are otherwise identical. This is due to such factors as component accuracy and variations in intake pipe shape. Non-uniformity will thereby arise between the air/fuel ratios of the mixture supplied to the respective cylinders. Thus, if the aforementioned compensation value is computed on the basis of the output from an oxygen concentration sensor, it may not be possible to obtain a desired improvement in exhaust pollution elimination effectiveness.

SUMMARY OF THE INVENTION

It is an objective of the present invention to provide a method of air/fuel ratio control for an internal combustion engine, utilizing an oxygen concentration sensor which produces an output varying in proportion to oxygen concentration, whereby compensation values are accurately computed for compensating errors of a basic value, to attain a high accuracy of air/fuel ratio control and improved elimination of exhaust pollutants.

With an air/fuel ratio control method according to the present invention, during an engine operating condition in which the deviation from a target air/fuel ratio of a detected air/fuel ratio is below a predetermined level, where the detected air/fuel ratio is obtained by utilizing the output from an oxygen concentration sensor, respective compensation values are computed and updated for the individual cylinders of the engine, with these compensation values being computed in accordance with variations in the magnitude of the detected air/fuel ratio.

More particularly, the present invention provides a method of air/fuel ratio control for a multicylinder internal combustion engine provided with at least one oxygen concentration sensor mounted within an exhaust system of the internal combustion engine for producing an output which varies substantially in proportion to the concentration of oxygen in the exhaust gas from the engine, the method comprising:

setting a basic value for air/fuel ratio control, in accordance with a plurality of engine operating parameters relating to engine load;

detecting the air/fuel ratio of a mixture supplied to the engine, based upon the output from the oxygen concentration sensor;

compensating the basic value by at least a firs: compensation value which is derived in accordance with a deviation from a target air/fuel ratio of an air/fuel ratio detected utilizing the output from the oxygen concentration sensor and by a second compensation value which is derived in accordance with an error of the basic value, to thereby determine an output value with respect to the target air/fuel ratio and;

controlling the air/fuel ratio of the mixture in accordance with the output value;

with the method of the present invention being characterized in:

detecting an operating condition of the engine in which the deviation from the target air/fuel ratio of the detected air/fuel ratio is lower than a predetermined value and, during this operating condition, computing and updating respective individual values of the second compensation value for the respective cylinders of the engine, each of these computations being executed in accordance with the magnitude of a change in the detected air/fuel ratio.

DETAILED DESCRIPTION OF THE INVENTION

Figure 1:
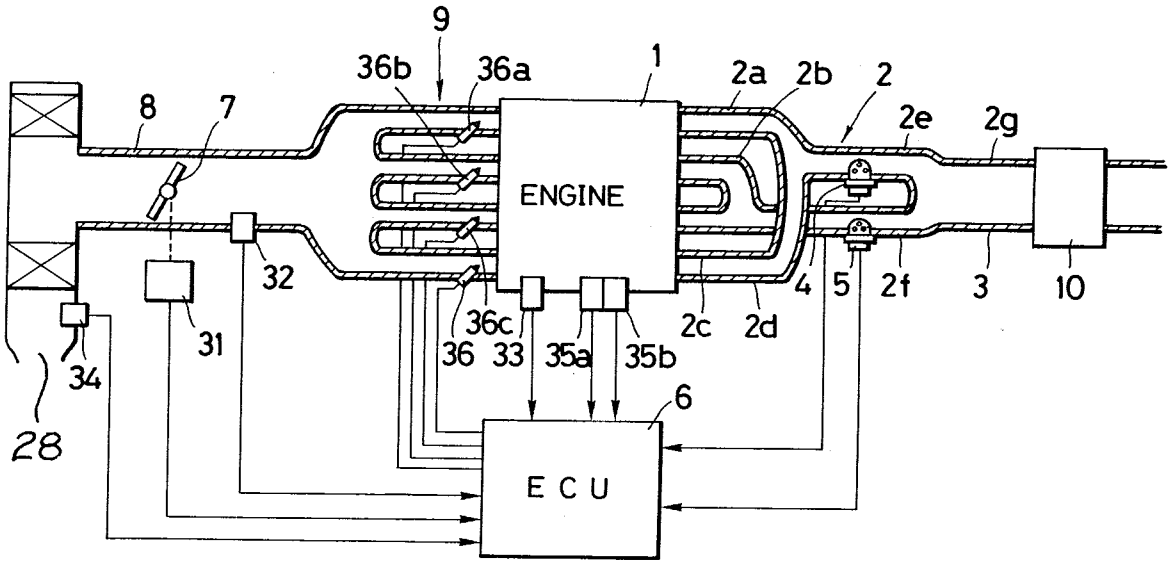
FIG. 1 shows an electronic control fuel injection apparatus according to the present invention which employs an air/fuel ratio control method according to the present invention.

An embodiment of the present invention will be described, referring to the drawings.

Figure 2:
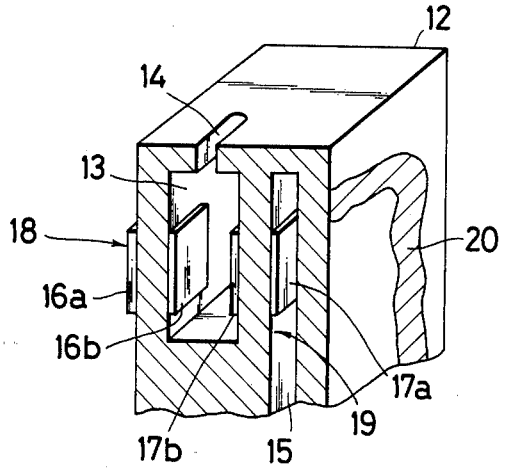
FIG. 2 shows the interior of a sensor unit of an oxygen concentration sensor.
Figures 3, 3A:
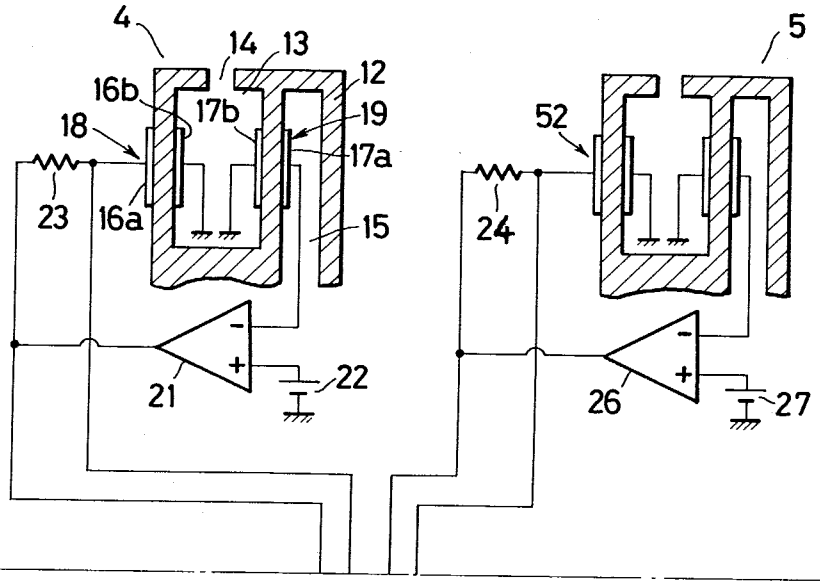
FIGS. 3, 3A and 3B are block circuit diagrams of an ECU (Electronic Control Unit)
Figure 3B:
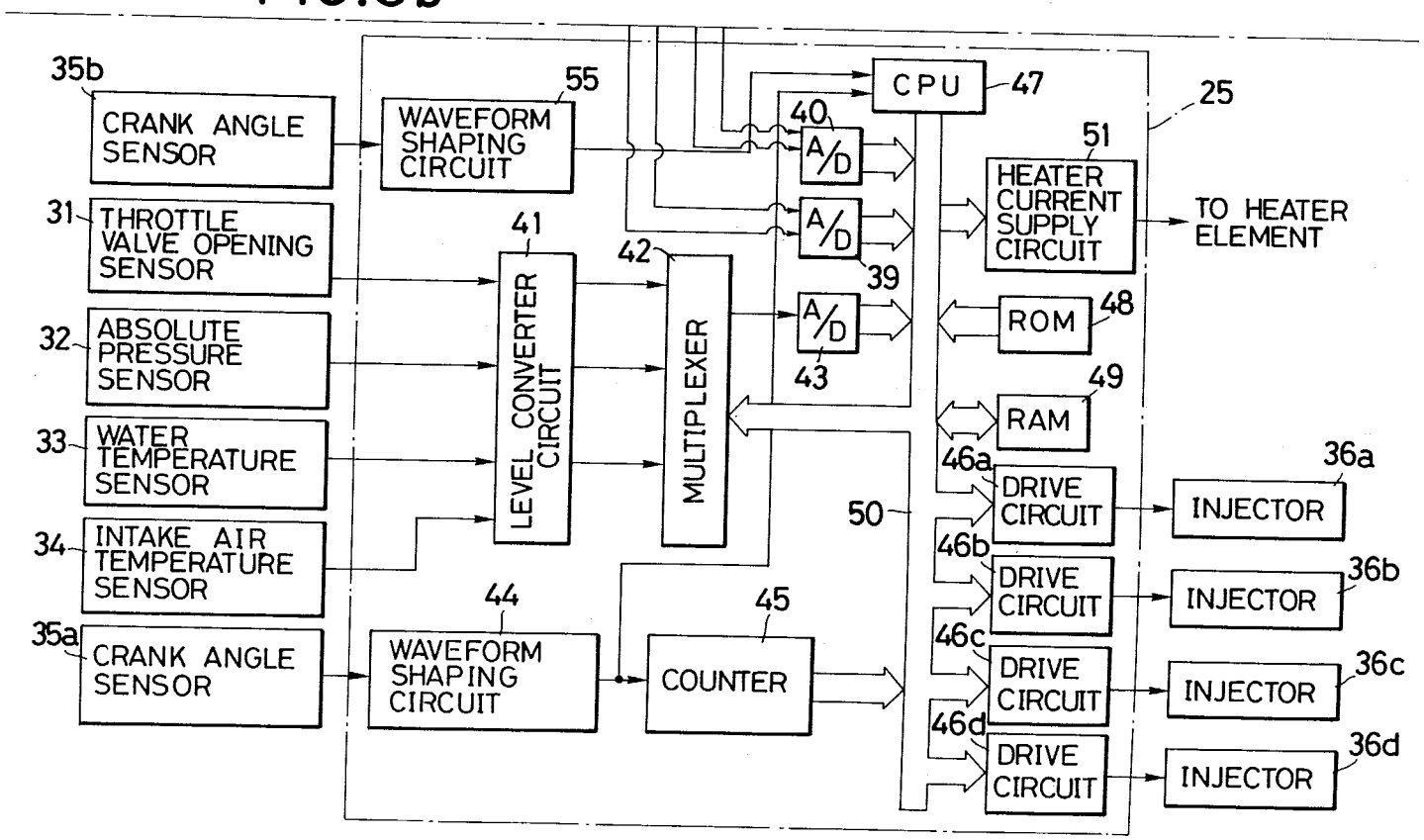

FIGS. 1 through 3 illustrate an electronic control fuel injection apparatus for a 4-cylinder fuel injection internal combustion engine which employs an air/fuel ratio control method according to the present invention. In this embodiment, exhaust branch pipes 2 of the respective cylinders of a multi-cylinder internal combustion engine 1 (these cylinders being respectively referred to hereinafter as the first through the fourth cylinders) are arranged such that a first cylinder pipe section 2*a* (i.e. a pipe section which is coupled to receive exhaust gas from the first cylinder of engine 1) and a fourth cylinder pipe section 2*d* are merged into a common pipe section 2*e*, while a second cylinder pipe section 2*b* and a third cylinder pipe section 2*c* are merged into a common pipe section 2*f*. The common pipe sections 2*e* and 2*f* are merged downstream from the positions at which sectiors 2*a* to 2*d* are merged, into a common pipe section 2*g*. The common pipe section 2*g* is connected to an exhaust pipe 3. A three way catalytic converter 10 is mounted within the exhaust pipe 3.

Sensor units 4 and 5, of first and second oxygen concentration sensors respectively, are mounted in the common pipe sections 2*e* and 2*f* respectively. Inputs and outputs of the sensor units 4 and 5 are coupled to an ECU (Electronic Control Unit) 6.

Each of the sensor units 4 and 5 has the internal configuration shown in FIG. 2. A protective case of the sensor unit 4 contains an oxygen ion-conductive solid electrolytic member 12, which can have a substantially rectangular shape as shown. A gas holding chamber 13 is formed in the interior of the solid electrolytic member 12, and communicates via a lead-in aperture 14 with exhaust gas at the exterior of solid electrolytic member 12, constituting a gas to be sampled, The lead-in aperture 14 is positioned such that the exhaust gas will readily flow from the interior of the exhaust pipe into the gas holding chamber 13. In addition, an atmospheric reference chamber 15 is formed within the solid electrolytic member 12, into which atmospheric air is led. The atmospheric reference chamber 15 is separated from the gas holding chamber 13 by a porticn of the solid electrolytic member 12 serving as a partition. As shown, pairs of electrodes 17*a*, 17*b* and 16*a*, 16*b* are respectively formed on the partition between chambers 13 and 15 and on the wall of chamber 13 on the opposite side to the chamber 15. The solid electrolytic member 12 functions in conjunction with the electrodes 16*a* and 16*b* as an oxygen pump element 18, and functions in conjunction with electrodes 17*a*, 17*b* as a sensor cell element 19. A heater element 20 is mounted on the external surface of the atmospheric reference chamber 15. Sensor unit 5 of the second oxygen concentration sensor is configured in the same way as sensor unit 4.

The oxygen ion-conductive solid electrolytic member 12 is formed of $ZrO_2$ (zirconium dioxide), while the electrodes 16*a* through 17*b* are each formed of platinum.

As shown in FIG. 3, ECU 6 includes an oxygen concentration sensor control section, consisting of a differential amplifier 21, a reference voltage source 22, and resistor 23. The manner of connection of the first oxygen concentration sensor to ECU 6 will first be described. Electrode 16*b* of the oxygen pump element 18 and electrode 17*b* of sensor cell element 19 are each connected to ground potential. Electrode 17*a* of sensor cell element 19 is connected to an input of differential amplifier 21, which produces an output voltage in accordance with the difference between the voltage appearing between electrodes 17*a*, 17*b* and the output voltage of reference voltage source 22. The output voltage of voltage source 22 corresponds to the stoichiometric air/fuel ratio, i.e. 0.4 V. The output terminal of differential amplifier 21 is connected through the current sensing resistor 23 to electrode 16*a* of the oxygen pump element 18. The terminals of current sensing resistor 23 constitute the output terminals of the first oxygen concentration sensor, and are connected to the control circuit 25, which is implemented as a microprocessor. The control section of the second oxygen concentration sensor consists of a differential amplifier 26, a reference voltage source 27, a resistor 28, and is connected to control circuit 25 in the same way as for the first oxygen concentration sensor.

A throttle valve opening sensor 31 which produces an output voltage in accordance with the degree of opening of throttle valve 7, and which can be implemented as a potentiometer, is coupled to control circuit 25, to which is also connected an absolute pressure sensor 32 which is mounted in intake pipe 8 at a position downstream from the throttle valve 7 and which produces an output voltage varying in level in accordance with the absolute pressure within the intake pipe 8. A water temperature sensor 33 which produces an output voltage varying in level in accordance with the temperature of the engine cooling water, an intake temperature sensor 34 which is mounted near an air intake aperture 28 and produces an output at a level which is determined in accordance with the intake air temperature, and crank angle sensors 35*a* and 35*b*, which generate signal pulses in synchronism with rotation of the crankshaft (not shown in the drawings) of engine 1 are also connected to control circuit 25. The crank angle sensor 35*a* produces an output pulse each time the crankshaft rotates through 180°. Crank angle sensor 35*b* produces an output pulse each time the crankshaft rotates through 720°. The injectors 36*a* through 36*d* are connected to the control circuit 25 and mounted in the intake branch pipes 9, as shown in FIG. 1, at positions close to the intake valves (not shown in the drawings) of the respective cyliders engine 1.

Control circuit 25 includes A/D converters 39 and 40 which respectively receive the voltages developed across current sensing resistors 23 and 24 as differential inputs, and converts these voltages to respective digital signals. Control circuit 25 also includes a level converter circuit 41 which performs level conversion of each of the output signals from the throttle valve opening sensor 31, the absolute pressure sensor 32, the intake temperature sensor 34, and the water temperature sensor 33. The resultant level-converted signals from level converter circuit 41 are supplied to inputs of a multiplexer 42. Control circrit 25 also includes an A/D converter 43 which converts tle output signals from multiplexer 42 to digital form, waveform shaping circuit 44 which execute waveform shaping of the output signal from the crank angle sensor 35*a* and 35*b* to produce TDC (Top Dead Center) signal pulse as output, and a counter 45 which counts a number of clock pulses (produced from a clock pulse generating circuit which is not shown in the drawings) during each interval between successive TDC pulses from the waveform shaping circuits 44. Control circuit 25 further includes drive circuits 46*a* through 46*d* for driving a set of fuel injector 36*a* through 36*d* respectively, a CPU (central processing unit) 47 for performing digital computation in accordance with a program, a ROM (read-only memory) 48 having various processing programs and data stored therein, and a RAM (random access memory) 49. The A/D converters 39 and 43, multiplexer 42, counter 45, drive circuits 46*a* through 46*d*, CPU 47, ROM 48 and RAM 49 are mutually interconnected by an input/output bus 50. TDC signal pulses produced from crank angle sensor 35*a* are supplied through waveform shaping circuit 44 to CPU 47, while in addition, a reference cylinder signal, produced from crank angle sensor 35*b* and transferred through waveform shaping circuit 55, is supplied to CPU 47. The control circuit 25 also includes a heater current supply circuit 51, which can for example include a switching element which is responsive to a heater current supply command from CPU 47 for applying a voltage between the terminals of heater element 20, to thereby supply heater current and produce heating of heater element 20. RAM 49 is a non-volatile type of back-up memory, whose contents are not erased when the engine ignition switch (not shown in the drawings) is turned off.

Data representing a pump current value $I_P$ corresponding to the current flow through the oxygen pump element 18 of the first oxygen concentration sensor, transferred from A/D converter 39, data representing a pump current value $I_P$ corresponding to the current flow through the oxygen pump element 52 of the second oxygen concentration sensor, transferred from A/D converter 40, together with data representing a degree of throttle valve opening $\theta_{th}$, data representing the absolute pressure $P_{BA}$ within the intake pipe, and data representing the cooling water temperature $T_W$ and intake air temperature $T_A$, respectively selected and transferred by A/D converter 43, are supplied to CPU 47 over the I/O bus 50. In addition data expressing a count value from counter 45, which is attained during each period of the TDC pulses, is also supplied to CPU 47 over I/O bus 50.

Oxygen concentration sensing by the first oxygen concentration sensor will first be described. When the supply of pump current to oxygen pump element 18 begins, if the air/fuel ratio of the mixture which is supplied to engine 1 at that time is in the lean region, then the voltage which is produced between electrodes 17*a* and 17*b* of the sensor cell element 19 will be lower than the output voltage from the reference voltage source 22, and as a result the output voltage level from the differential amplifier 21 will be positive. This positive voltage is applied across the series-connected combination of resistor 23 and oxygen pump element 18. A pump current thereby flows from electrode 16a to electrode 16b of the oxygen pump element 18, so that the oxygen within the gas holding chamber 13 becomes ionized by electrode 16b, and flows through the interior of oxygen pump element 18 from electrode 16b, to be ejected from electrode 16a as gaseous oxygen. Oxygen is thereby drawn out of the interior of the gas holding chamber 13.

As a result of this withdrawal of oxygen from the gas holding chamber 13, a difference in oxygen concentration will arise between the exhaust gas within gas holding chamber 13 and the atmospheric air within the atmospheric reference chamber 15. A voltage $V_S$ is thereby produced between electrodes 17a and 17b of the sensor cell element 19 at a level determined by this difference in oxygen concentration, and the voltage $V_S$ is applied to the inverting input terminal of differential amplifier 21. The output voltage from differential amplifier 21 is proportional to the voltage difference between the voltage $V_S$ and the voltage produced from reference voltage source 22, and hence the pump current is proportional to the oxygen concentration within the exhaust gas. The pump current value is output as a value of voltage appearing between the terminals of current sensing resistor 23.

When the air/fuel ratio is within the rich region, the voltage $V_S$ will be higher than the output voltage from reference voltage source 22, and hence the output voltage from differential amplifier 21 will be inverted from the positive to the negative level. In response to this negative level of output voltage, the pump current which flows between electrodes 16a and 16b of the oxygen pump element 18 is reduced, and the direction of current flow is reversed. Thus, since the direction of flow of the pump current is now from the electrode 16b to electrode 16a, oxygen will be ionized by electrode 16a, so that oxygen will be transferred as ions through oxygen pump element 18 to electrode 16b, to be emitted as gaseous oxygen within the gas holding chamber 13. In this way, oxygen is drawn into gas holding chamber 13. The supply of pump current is thereby controlled such as to maintain the oxygen concentration within the gas holding chamber 13 at a constant value, by drawing oxygen into or out of chamber 13, so that the pump current $I_P$ of that sensor will always be substantially proportional to the oxygen concentration in the exhaust gas, both for operation in the lean region and in the rich region of the air/fuel ratio. The operation of the second oxygen concentration sensor is identical to that of the first oxygen concentration sensor, and the pump current $I_P$ of the second oxygen concentration sensor is also substantially proportional to the oxygen concentration in the exhaust gas, both for operation in the lean region and in the rich region.

Figure 4A:
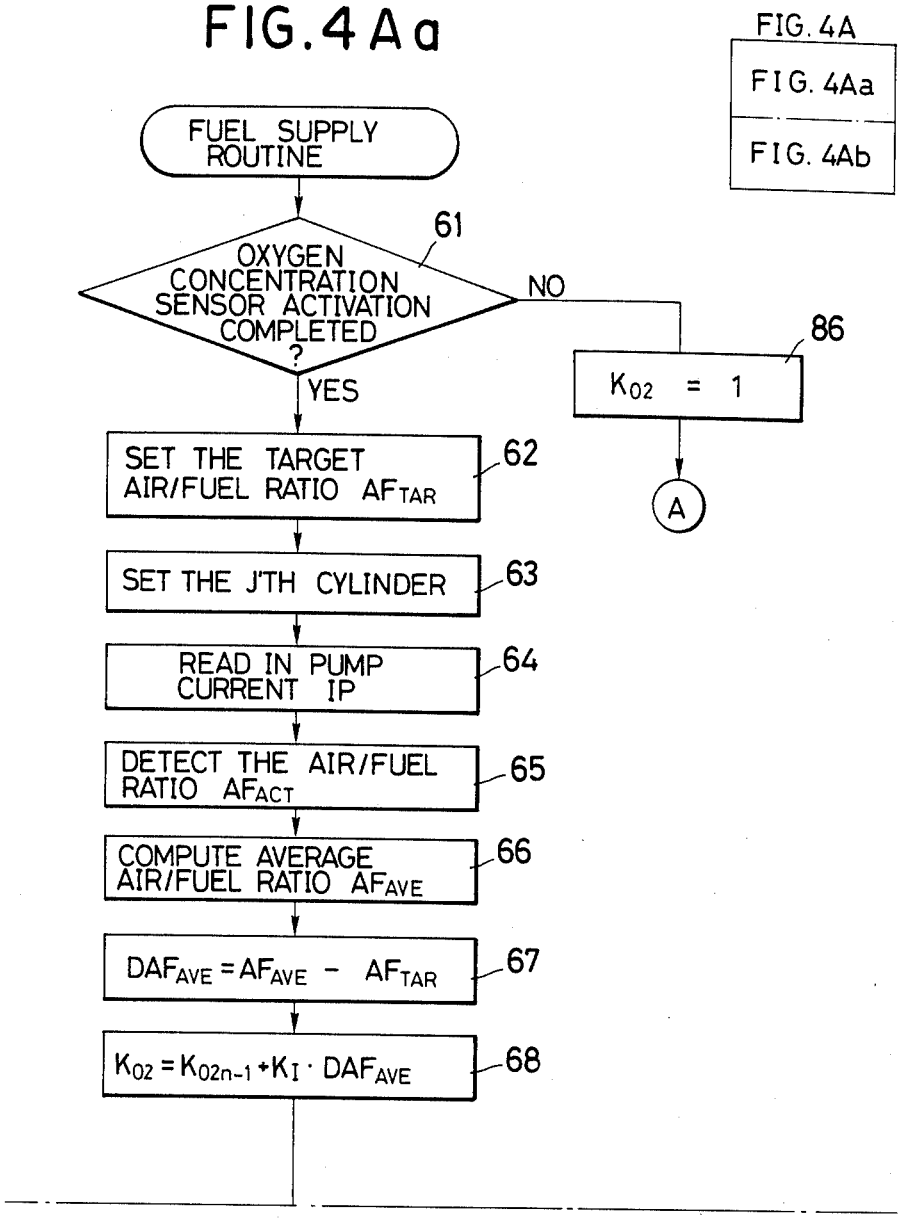
FIGS. 4(*a*), (*b*), 5(*a*), 5(*b*) and 6 are flow charts to illustrate CPU operation.
Figure 4A:
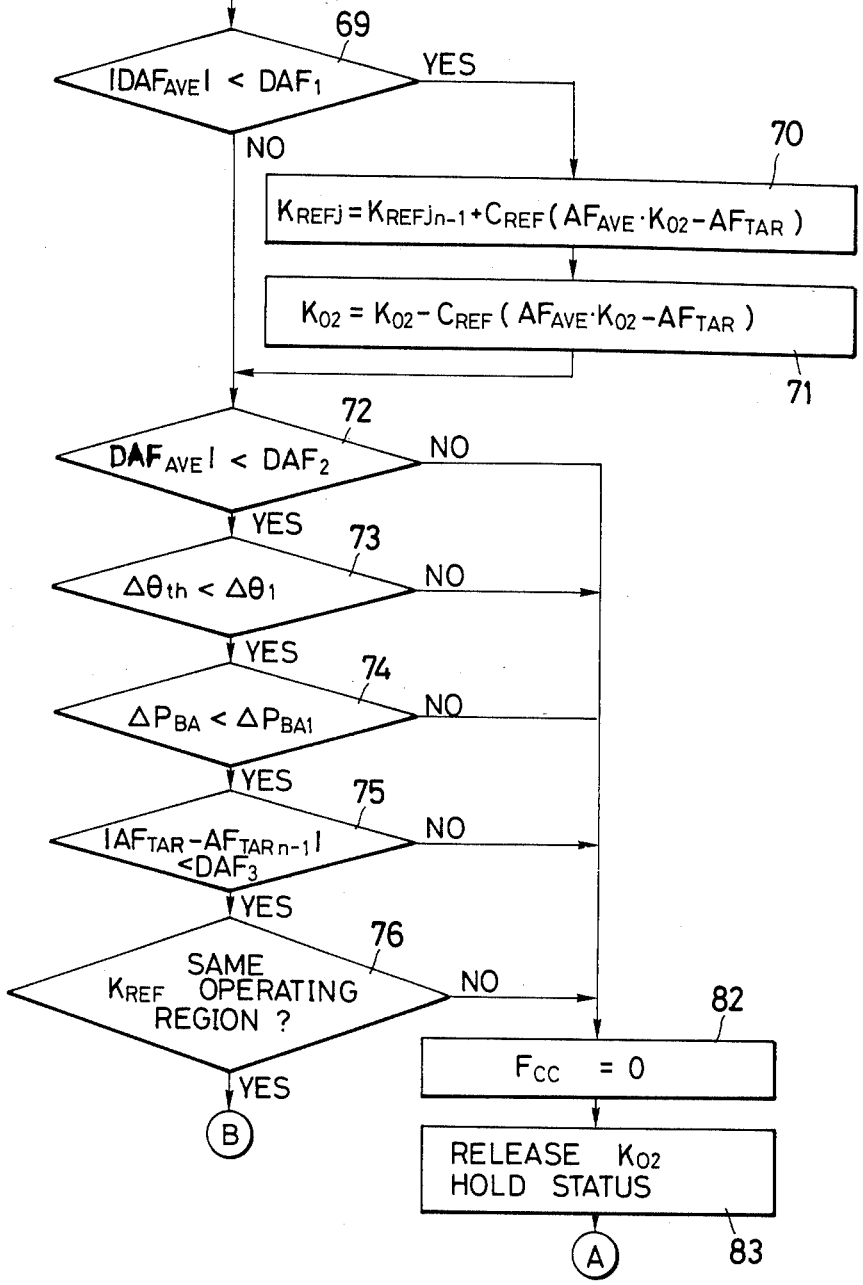
Figure 4B:
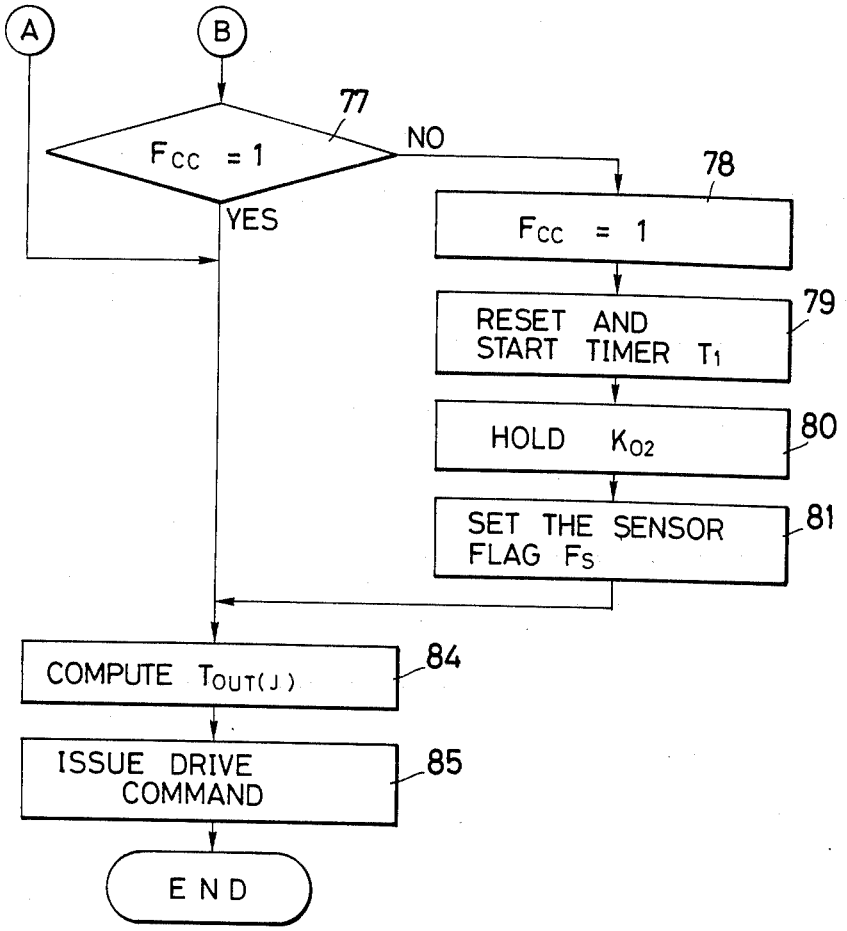
Figure 5A:
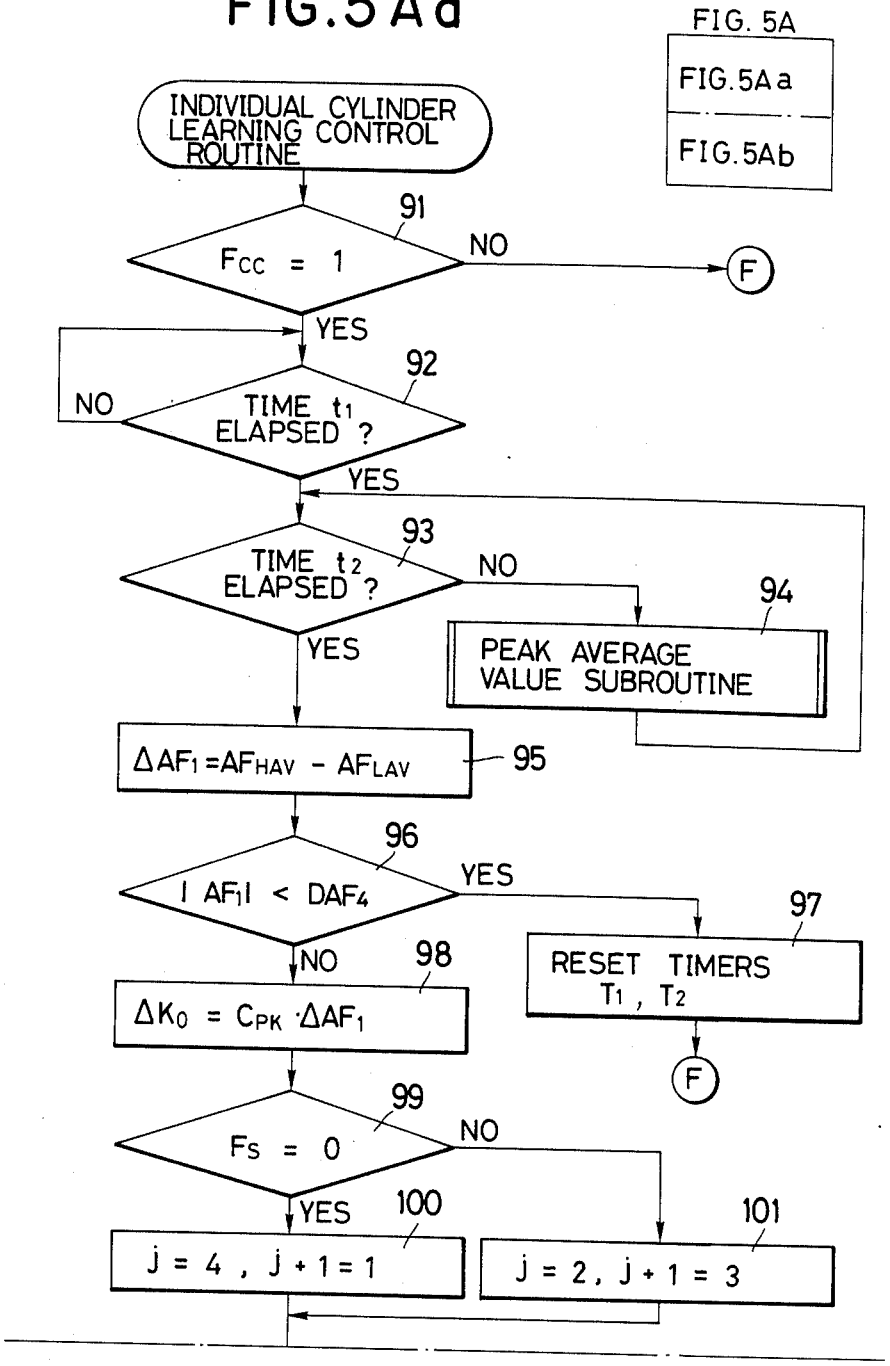
Figure 5A:
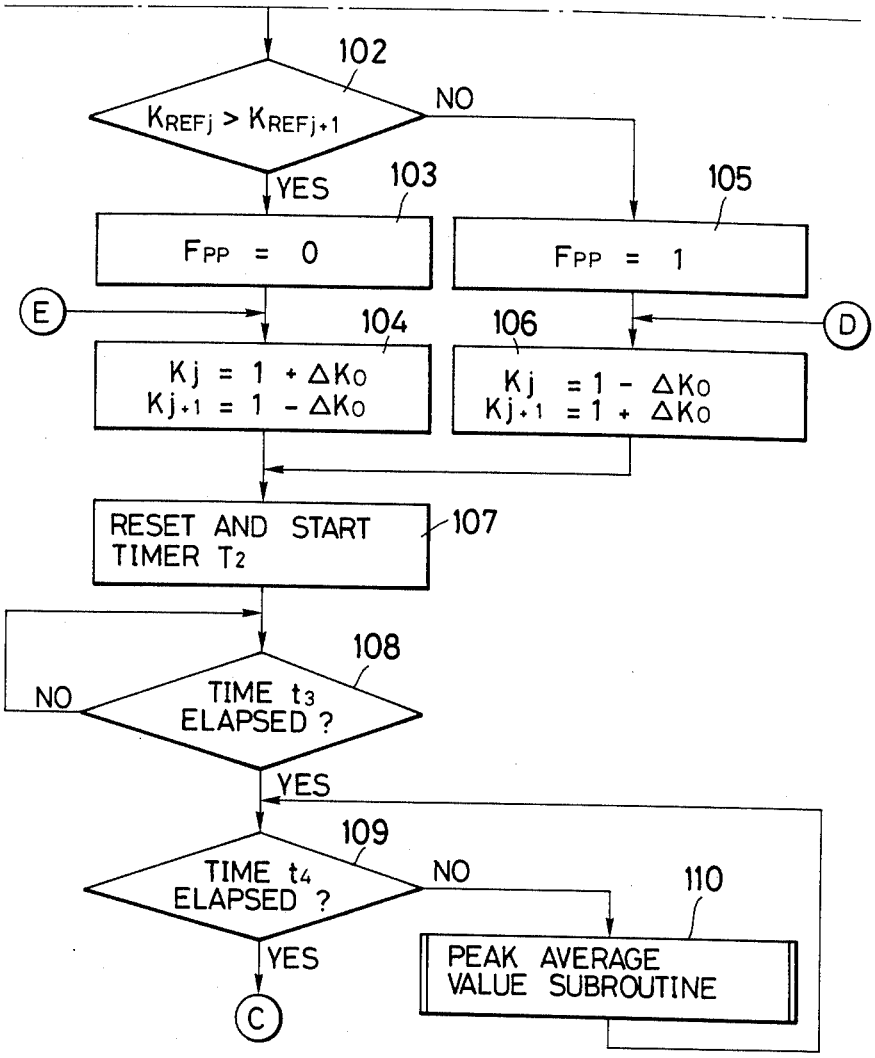
Figure 5B:
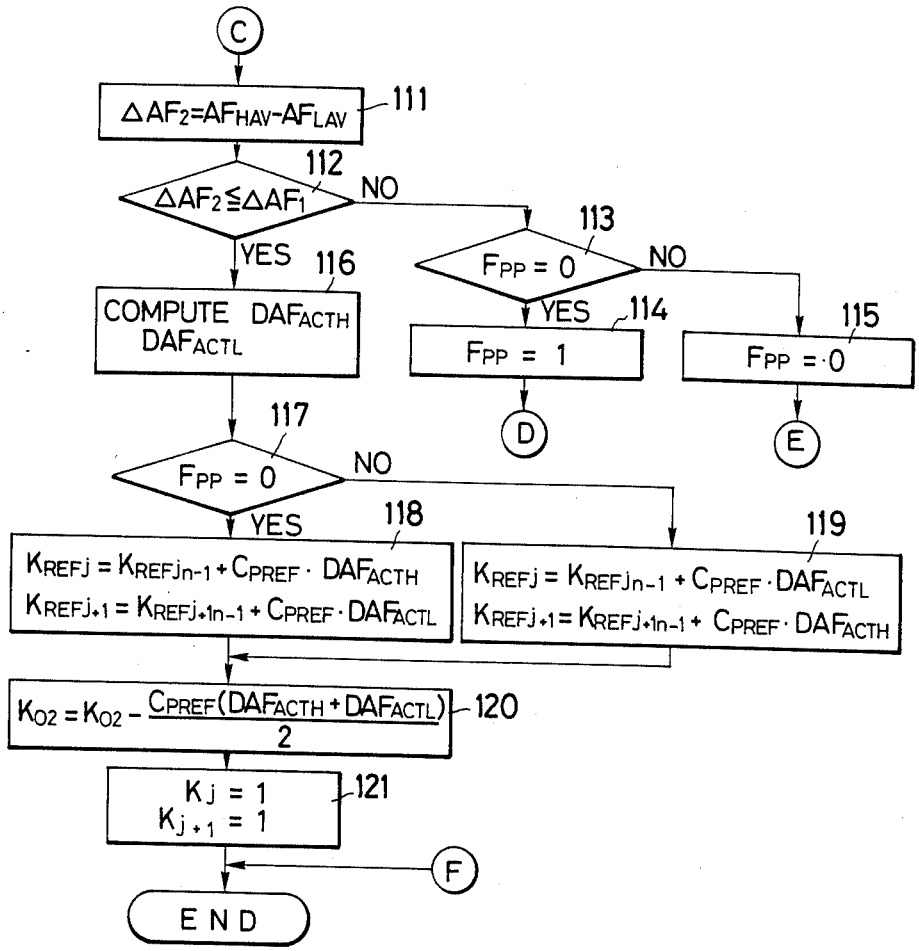

An operating sequence for an embodiment of an air/fuel ratio control method according to the present invention will be described, referring to operating flow charts for CPU 47 shown in FIGS. 4 through 6.

Each time a TDC (Top Dead Center) pulse is generated, CPU 47 produces an internal interrupt signal, and a fuel supply routine is executed in response to this interrupt signal. The fuel supply routine is shown in FIGS. 4(*a*) and 4(*b*). Firstly, a decision is made as to whether or not activation of the first and second oxygen concentration sensors has been completed (step 61). This decision is based upon the time which has elapsed since the start of supplying heater current to the respective heater elements of these oxyg en concentration sensors, or can be based upon the cooling water temperature $T_W$. If it is decided that activation of the heater elements has been completed, a target air/fuel ratio $AF_{TAR}$ is set, in accordance with various types of data (step 62). The value of $AF_{TAR}$ can be set, for example, by searching an AF data map which is stored beforehand in ROM 48, with the search being executed in accordance with the current operating condition of the engine, i.e. with the memory map location from which the target air/fuel ratio value $AF_{TAR}$ is taken being in accordance with that operating condition. The engine operating condition is judged on the basis of the engine speed of rotation $N_e$ and absolute pressure $P_{BA}$ within the intake pipe. The number of the cylinder which is to be supplied with fuel as a result of the current execution of the fuel supply routine is then set. The cylinder which is tus determined will be referred to in the following as the j'th cylinder (step 63). The pump current $I_P$ of the oxygen concentration sensor whose sensor unit (4 or 5) is mounted in the common pipe section (2e or 2f)corresponding to the j'th cylinder is then read in by CPU 47 (step 64). Fuel supply to the cylinders is performed in the sequence first cylinder—third cylinder—fourth cylinder—second cylinder. The j'th cylinder is determined with respect to the first cylinder. Specifically, immediately prior to generation of the TDC pulse corresponding to the first cylinder (i.e. the TDC pulse which initiates execution of the fuel supply routine for supplying fuel to the first cylinder), a reference cylinder signal is generated. When the j'th cylinder is the first or the fourth cylinder, the pump current $I_P$ from the first oxygen concentration sensor is read in, while if the j'th cylinder is the second or the third cylinder, the pump current $I_P$ from the second oxygen concentration sensor is read in. The detected air/fuel ratio $AF_{ACT}$, represented by the pump current $I_P$ thus read in, is obtained from an $AF_{ACT}$ data map (which has been stored beforehand in ROM 48). The $AF_{ACT}$ value for the j'th cylinder thus obtained is then stored in memory. (step 65). This storage of $AF_{ACT}$ must be completed at least before $n_{AVE}$ cycles have elapsed following the TDC pulse for the j'th cylinder, where $n_{AVE}$ is equal to 1 for the present embodiment. One cycle is defined as the time taken for the crank angle to reach 720°, after generation of a TDC pulse. After obtaining the current detected air/fuel ratio $AF_{ACT}$ (i.e. for the j'th cylinder), that value of air/fuel ratio is added to the other values of detected air/fuel ratio $AF_{ACT}$ which have been obtained during $n_{AVE}$ cycles. More specifically, in the case of the 4-cylinder engine of this embodiment, the detected air/fuel ratio $AF_{ACT}$ obtained for the j'th cylinder and the values of $AF_{ACT}$ which have been previously obtained and stored for the remaining three cylinders, during the preceding $n_{AVE}$ executions of this routine respectively (i.e. the preceding three executions, if $n_{AVE}$ is one), are added together. The resultant value is then divided by $4n_{AVE}$ (i.e. is divided by 4, assuming that $n_{ave}$ is one), to thereby compute an average air/fuel ratio $AF_{AVE}$ (step 66). The deviation $DAF_{AVE}$ of this average air/fuel ratio $AF_{AVE}$ from the target air/fuel ratio $AF_{TAR}$ is then computed (step 67). The air/fuel ratio feedback compensation coefficient $K_{O2(n-1)}$ obtained and stored during a previous execution of the routine is then read out, and an air/fuel ratio feedback compensation coefficient $K_{O2}$ is then computed by multiplying the deviation $DAF_{AVE}$ by a $K_{O2}$ feedback integral coefficient $K_I$ and adding to the result of this multiplication the air/fuel ratio feedback compensation coefficient $K_{02(n-1)}$ which has been read out (step 68). A decision is then made as to whether or not the absolute value of deviation $DAF_{AVE}$ is smaller than a predetermined value $DAF_1$ (step 69). If $|DAF_{AVE}| \geqq DAF_1$, then a decision is made as to whether or not the absolute value of $DAF_{AVE}$ is smaller than a predetermined value $DAF_2$ (where $DAF_1 > DAF_2$) (step 72). If $|DAF_{AVE}| < DAF_1$, on the other hand, then since this indicates that the deviation $DAF_{AVE}$ is small, a learning control compensation coefficient $K_{REF(j)}$ for the j'th cylinder is computed by using the following equation, and the result is stored at a memory location (a,b) in a $K_{REF(j)}$ data map step 70).

$$K_{REF(j)} = K_{REF(j)(n-1)} + C_{REF} (AF_{AVE} \cdot K_{O2} - AF_{TAR}) \quad (1)$$

In the above, $K_{REF(j)(n-1)}$ is a value of this compensation coefficient which was obtained and stored during a previous execution of this routine, and which is read out from RAM 49. $C_{REF}$ is a convergence coefficient for uniform learning control for all cylinders. The quantity a in memory location (a,b) is one of a set of values 1, 2, . . . x which is determined in accordance with the engine speed of rotation $N_e$, while quantity b is one of a set of values 1, 2, . . . y which is determined in accordance with the absolute pressure $P_{BA}$ within the intake pipe.

If the compensation coefficient $K_{REF(j)}$ is computed and updated by executing step 70, the value of the air/fuel ratio feedback compensation coefficient $K_{O2}$ which was computed in step 68 will be excessively high. In this case, therefore, $K_{O2}$ is recomputed by employing equation (2) below (step 71). Step 72 is then executed.

$$K_{O2} = K_{O2} - C_{REF} (AF_{AVE} \cdot K_{O2} - AF_{TAR}) \quad (2)$$

If it is judged in step 72 that $|DAF_{AVE}| < DAF_2$, then the degree of throttle valve opening $\theta_{th}$ is detected and read in, the value for tte degree of throttle valve opening $\theta_{th(n-1)}$ which was obtained and stored during a previous execution of this routine is read out, and a decision is made as to whether or not the change $\Delta\theta$th in the degree of throttle valve opening between the degree of throttle valve opening $\theta_{th}$ detected during this execution of the routine and $\theta_{th(n-1)}$ is smaller than a predetermined value $\Delta\theta_1$ (step 73 . If $\Delta\theta_{th} > \Delta\theta_1$, then the absolute pressure $P_{BA}$ within the intake pipe is detected and read in as a current detection value, and the amount of change $\Delta P_{BA}$ between the previous detection value $P_{BA(n-1)}$ and the current detection value $P_{BA}$ is computed. A decision is then made as to whether the amount of change $\Delta P_{BA}$ is less than a predetermined value $\Delta P_{BAl}$ step 74). If $\Delta P_{BA} < \Delta P_{BAl}$, then a decision is made as to whether or not the absolute value of the difference between the current target air/fuel ratio $AF_{TAR}$ and the value of target air/fuel ratio $AF_{TAR(n-1)}$ detected in a previous execution of the routine, $AF_{TAR(n-1)}$ is smaller than a predetermined value $DAF_3$ (step 75). If $|AF_{TAR} - AF_{TAR(n-1)}| < DAF_3$, then a decision is made as to whether or not the current engine operating region (as determined by the engine speed $N_e$ and the absolute pressure $P_{BA}$ within the intake pipe) which is utilized in searching the $K_{REF(j)}$ data map for the learning control compensation coefficient $K_{REF(j)}$ is the same as the engine operating region which was used in searching for $K_{REF(j)(n-1)}$ (i.e. a decision is made as to whether or not the memory location (a,b) used in this search of the $K_{REF(j)}$ data map is the same as the memory location $(a,b)_{(n-1)}$ from which $K_{REF(j)}$ was last obtained) (step 76).

If all of the following conditions are satisfied:

$|DAF_{AVE}| < DAF_2$, $\Delta\theta_{th} \geqq \Delta\theta_1$, $\Delta P_{BA} < \Delta P_{BAl}$, $|AF_{TAR} - AF_{TAR(n-1)}|) < DAF_3$, and $(a,b) = (a,b)_{n-1}$, then a decision is made as to whether or not the individual cylinder learning flag $F_{CC}$ is set to the 1 state (step 77). If $F_{CC} = 0$, then $F_{CC}$ is set to 1 (step 78), and a timer $T_1$ (not shown in the drawings) within CPU 47 is reset to begin elapsed time measurement (step 79). The value of the compensation coefficient $K_{O2}$ that has been computed in steps 68 or 71 of this execution of the routine is thereafter maintained unchanged in a hold status, irrespective cf the results of subsequent computations, until this hold status is released (step 80). The sensor flag $F_S$ is then set to the 0 or the 1 state, in accordance with the oxygen concentration sensor that has been selected to be used during this execution of the routine (step 81). That is to say, if j=1 or 4, then $F_S$ is made 0, while if j=2 or 3, then $F_S$ is set to 1. If on the other hand at least one of the following conditions is satisfied:

$|DAF_{AVE}| \geqq DAF_2$, $\Delta\theta_{th} \geqq \Delta\theta_1$, $P_{BA} \geqq \Delta P_{BA1}$, $|AF_{TAR} - AF_{TAR(n-1)}| \geqq DAF_3$, $(a,b) \neq (a,b)_{n-1}$, then the individual cylinder learning flag $F_{CC}$ is reset to 0 (step 82), and the holding status of the compensation coefficient $K_{O2}$ is released (step 83). After step 81 or step 83 has been executed, or if it is judged that $F_{CC} = 1$ in step 77, the fuel injection interval $T_{OUT(j)}$ is computed. This fuel injection interval determines the amount of fuel which is supplied to the j'th cylinder of engine 1 as a result of this execution of the routine, and is computed using a predetermined equation (step 84). A drive command which expresses this fuel injection interval $T_{OUT(j)}$ is then supplied to one of the drive circuits 46*a* to 46*d* which drives a corresponding one of the injectors 36*a* to 36*d*, (i.e. the injector of the j'th cylinder) (step 85). The selected injector is thereby driven to supply fuel to the j'th cylinder of engine 1.

The fuel injection interval $T_{OUT(j)}$ can for example be computed from the following equation:

$$T_{OUT} = T_i \times K_{O2} \times K_{REF} \times K_j{}^x K_{WOT} \times K_{TW} + T_V \quad (3)$$

In the above equation, $T_i$ is a basic value for air/fuel ratio, which constitutes a basic injection time and is obtained by searching a data map stored in ROM 48, in accordance with the engine speed of rotation $N_e$ and the absolute pressure $P_{BA}$ in the intake pipe. $K_J$ is an air/fuel ratio successive control coefficient for the j'th cylinder $K_{WOT}$ is a fuel quantity increment compensation coefficient, which is applied when the engine is operating under high load, and $K_{TW}$ is a cooling water temperature coefficient. $T_V$ is a voltage compensation value, which is established in accordance with the power supply voltage level of the electronic control fuel injection apparatus.

If it is judged in step 61 that activation of both the first and second oxygen concentration sensors has not yet been completed, then the compensation coefficient $K_{O2}$ is made equal to 1 (step 86) and execution immediately moves to step 84.

An individual cylinder learning control routine will now be described, referring to FIGS. 5(*a*) and 5(*b*). Executions of the individual cylinder learning control routine are initiated in response to clock pulses which are separate from the TDC signal. At the start of the routine, CPU 47 judges whether or not the individual cylinder learning flag $F_{CC}$ is set to the 1 state (step 91). If $F_{CC}=0$, then execution of the individual cylinder learning control routine is terminated. If $F_{CC}=1$, then a decision is made as to whether or not a time interval $t_1$ has elapsed since the individual cylinder learning flag $F_{CC}$ was set to the 1 state, with this decision being based on elapsed time measured by timer $T_1$ (step 92). Time $t_1$ is the time required for transfer from the intake system of engine 1 to the exhaust system. If $t_1$ has elapsed, then a decision is made as to whether or not a time interval $t_2$ has elapsed since the point at which tl elapsed. This decision is based on elapsed time measured by timer $T_1$ (step 93). Time interval $t_2$ represents a maximum time duration, following interval $t_1$, during which it is possible to obtain a high peak value and a low peak value of air/fuel ratio (described hereinafter) from the outputs of the first and second oxygen concentration sensors. If $t_2$ has not elapsed, then a peak average value subroutine is executed to compute a high peak average value $AF_{HAV}$ and a low peak average value $AF_{LAV}$ (step 94).

Figure 6:
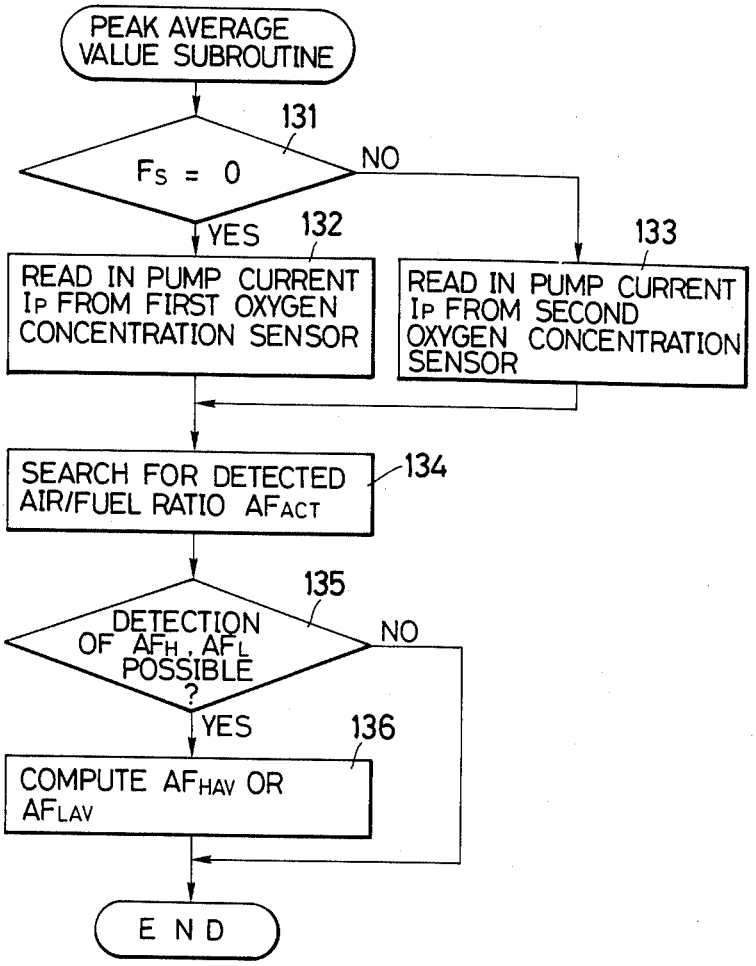

In this peak average value subroutine, as shown in the flow chart of FIG. 6, a decision is first made as to whether or not the sensor flag FS is in the 0 state (step 131). If $F_S=0$, then the pump current $I_P$ of the first oxygen concentration sensor is read in by CPU 47, at a predetermined sampling timing (step 132). If $F_S=1$, then the pump current $I_P$ of the second oxygen concentration sensor is read in at a predetermined sampling timing (step 133). The currently detected value of detected air/fuel ratio $AF_{ACT}$, expressed by the pump current $I_P$ which has thus been read in, is then obtained by searching the AF data map which has been stored beforehand in ROM 48, and is stored in memory (step 134). A decision is then made, based upon the stored value of detected air/fuel ratio, as to whether or not it is possible to detect a high peak value $AF_H$ or a low peak value $AF_L$ for each of the sets of cylinders respectively corresponding to the first and second oxygen concentration sensors (step 135). A high peak value and a low peak value are respectively defined as follows. If for example the currently detected air/fuel ratio is designated as $AF_{ACT(n)}$, the air/fuel ratio detected during the preceding execution of the routine as $AF_{ACT(n-1)}$, and the air/fuel ratio detected during the execution of the routine prior to that is designated as $AF_{ACT(n-2)}$ then if $AF_{ACT(n-2)} < AF_{ACT(n-1)}$, and $AF_{ACT(n-1)} > AF_{ACT(n)}$, then $AF_{ACT(n-1)}$ is detected as a high peak value, designated as $AF_H$. Similarly, if $AF_{ACT(n-2)} > AF_{ACT(n-1)}$, and $AF_{ACT(n-1)} > AF_{ACT(n)}$, then $AF_{ACT(n-1)}$ is detected as a low peak value and designated as $AF_L$. Successively detected values of high peak value $AF_H$ are added together and then divided by the number of detection operations, to thereby compute an average high peak value $AF_{HAV}$. Similarly, successively detected values of low peak value $AF_L$ are added together, and then divided by the number of detection operations to thereby obtain an average low peak value $AF_{LAV}$ (step 136).

When the average high peak value $AF_{HAV}$ and average low peak value $AF_{LAV}$ have been computed, step 93 is again executed and a decision is made as to whether or not time interval $t_2$ has elapsed following the point at which interval $t_1$ elapsed. If $t_2$ has elapsed, then the difference $\Delta AF_1$ between the average high peak value $AF_{HAV}$ and average low peak value $AF_{LAV}$ is computed (step 95), and a decision is made as to whether or not the absolute value of the difference $\Delta AF_1$ is smaller than a predetermined value $DAF_4$ (step 96). If $|\Delta AF_1| < DAF_4$, then timers $T_1$ and $T_2$ are reset and execution of the individual cylinder learning routine is terminated (step 97). If on the other hand $|\Delta AF_1| \geqq DAF_4$, then $\Delta K_O$ is computed by multiplying the difference $\Delta AF_1$ by an individual cylinder compensation coefficient $C_{PK}$ (step 98), and a decision is made as to whether or not the sensor flag $F_S$ is in the 0 state (step 99). If $F_S=0$, then j is made equal to 4, and j+1 is made equal to 1 (step 100). If $F_S=1$, then j is made equal to 2, and j+1 is made 3 (step 101). The compensation coefficients $K_{REF(j)}$ and $K_{REF(j+1)}$ are then obtained from location (a,b) of the $K_{REF(j)}$ data map and location (a,b) of the $K_{REF(j+1)}$ data map respectively, with these memory locations being determined in accordance with the engine speed of rotation $N_e$ and the absolute pressure $P_{BA}$ within the intake pipe. A decision is then made as to whether compensation coefficient $K_{REF(j)}$ is greater than $K_{REF(j+1)}$ (step 102). If $K_{REF(j)} > K_{REF(j+1)}$, then this is taken as indication that the air/fuel ratio of the j'th cylinder is more lean than that of the (J+1)'th cylinder, and a cylinder discrimination flag $F_{PP}$ is reset to 0 (step 103). One is then added to $\Delta K_0$, and the result is designated as the air/fuel ratio successive control coefficient $K_J$. $\Delta K_O$ is then subtracted from 1, and the result is designated as the control coefficient $K_{j+1}$ (step 104) If $K_{REF(j)} \leqq K_{REF(j+1)}$, then this is taken as indicating that the air/fuel ratio of the j'th cylinder is more rich than that of the (j+1)'th cylinder, and the cylinder discrimination flag $F_{PP}$ is set to 1 (step 105). $\Delta K_O$ is subtracted from 1, and the resultant value is designated as the air/fuel ratio successive control coefficient $K_j$, while $\Delta K_O$ is added to 1 and the result is designated as control coefficient $K_{j+1}$ (step 106). Each time that the fuel supply routine is executed when a TDC signal pulse occurs, and the fuel injection interval $T_{OUT(j)}$ is computed in accordance with equation (3) and fuel injection then performed, since the compensation coefficient $K_{O2}$ is held constant, the air/fuel ratio will vary in accordance with the effects of the control coefficients $K_j$ and $K_{j+1}$. After setting the values of the control coefficients $K_j$ and $K_{j+1}$, a timer $T_2$ (not shown in the drawings) within CPU 47 is reset and elapsed time measurement by that counter is started (step 107), and a decision is made as to whether or not a time interval $t_3$ has elapsed (as measured by timer $T_2$) (step 108). Time $t_3$ is the time required for transfer from the intake system of engine 1 to the exhaust system. If $t_3$ has elapsed, then a decision is made as to whether or not a time $t_4$ has elapsed since the point at which $t_3$ elapsed. This decision is based on elapsed time measured by timer $T_2$ (step 109). Time interval $t_4$ represents a maximum time duration, following interval $t_3$, during which it is possible to obtain a high peak value and a low peak value of air/fuel ratio (described hereinafter) from the outputs of the first and second oxygen concentration sensors, If $t_4$ has not elapsed, then a peak average value subroutine is executed to compute the high peak average value $AF_{HAV}$ and the low peak average value $AF_{LAV}$ (step 110).

After the high peak average value $AF_{HAV}$ and low peak average value $AF_{LAV}$ have been computed, step 109 is again executed and a decision is made as to whether or not the time interval $t_4$ has elapsed following the point at which interval $t_3$ elapsed. If $t_4$ has elapsed, then the difference $\Delta AF_2$ between the high peak average value $AF_{HAV}$ and low peak average value $AF_{LAV}$ is computed (step 111), and a decision is made as to whether or not the difference $\Delta AF_2$ is equal to or lower than $\Delta AF_1$ (step 112). If $\Delta AF_2 > \Delta AF_1$ then a decision is made as to whether or not the cylinder discrimination flag Fpp is equal to 0 since the result of the judging made in step 102 with respect to the air/fuel ratios of the j'th cylinder and the (j+1)'th cylinder is incorrect (step 113). If $F_{PP}=0$, then $F_{PP}$ is set to 1, and step 106 is again executed (step 114). If $F_{PP}=1$, then $F_{PP}$ is reset to 0, and step 104 is again executed (step 115). If $\Delta AF_2 \leqq \Delta AF_1$, then this indicates that the result of judging the relative air/fuel ratios of the j'th and the (j+1)'th cylinders in step 102 was correct, and a high peak deviation $DAF_{ACTH}$ and a low peak deviation $DAF_{ACTL}$ are respectively computed using the following equations (step 116).

$$DAF_{ACTH}=\{G(AF_{HAV}-AF_{AVE})+AF_{AVE}\}\cdot K_{O2}-AF_{TAR} \quad (3)$$

$$DAF_{ACTL}=\{G(AF_{LAV}-AF_{AVE})+AF_{AVE}\}\cdot K_{O2}-AF_{TAR} \quad (5)$$

Figure 7:
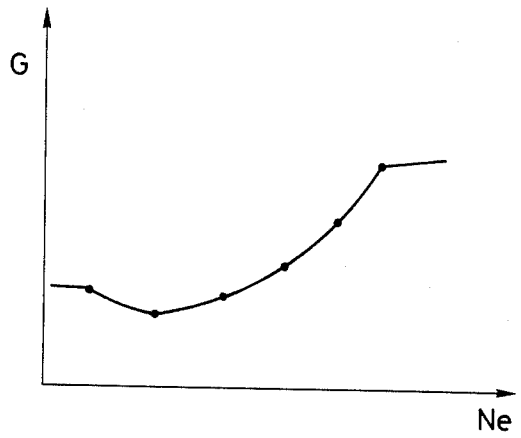
FIG. 7 is a graph showing the relationship between engine speed $N_e$ and a compensation coefficient G.
Figure 8:
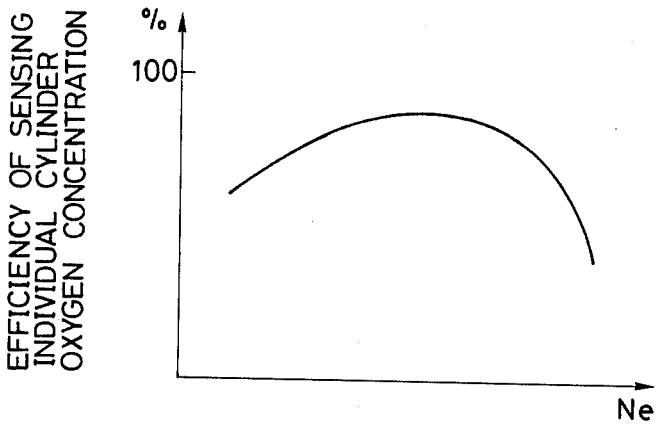
FIG. 8 is a graph showing the relationship between engine speed $N_e$ and individual cylinder air/fuel ratio detection performance of an oxygen concentration sensor.

In the above, G is an air/fuel ratio peak compensation coefficient. The relationship between compensation coefficient G and engine speed of rotation $N_e$ is shown graphically in FIG. 7. This relationship is stored as a data map in ROM 48, and a required value of G is obtained by searching this data map in accordance with the current engine speed of rotation $N_e$. This compensation coefficient G is utilized because, as shown in the graph of the relationship between individual cylinder oxygen concentration sensing performance and engine speed of FIG. 8, the sensing performance is lowered at high engine speeds due to the limitations of the oxygen concentration sensor speed of response, and is also lowered at low engine speeds due to the fact that the exhaust gas from an individual cylinder becomes dispersed and mixed with the exhaust gas from the other cylinders.

After computing the high peak deviation $DAF_{ACTH}$ and the low peak deviation $DAF_{ACTL}$, a decision is made as to whether or not the cylinder discrimination flag $F_{PP}$ is reset to 0 (step 117). If $F_{PP}=0$, then the compensation coefficients $K_{REF(j)}$ and $K_{REF(j+1)}$ are computed from equations (6) and (7) given below, and the computed values are respectively stored at memory locations (a,b) in the $K_{REF(j)}$ data map and the $K_{REF(j+1)}$ data map step 118).

$$K_{REF(j)}=K_{REF(j)(n-1)}+C_{PREF}\cdot DAF_{ACTH} \quad (6)$$

$$K_{REF(j+1)}=K_{REF(j+1)(n-1)}+C_{PREF}\cdot DAF_{ACTL} \quad (7)$$

In the above, $C_{PREF}$ is an individual cylinder learning control convergence coefficient.

If on the other hand $F_{PP}=1$, then the compensation coefficients $K_{REF(j)}$ and $K_{REF(j+1)}$ are respectively computed using equations (8) and (9) given below, and the computed values are respectively stored at memory locations (a,b) in the $K_{REF(j)}$ data map and the $K_{REF(j+1)}$ data map (step 119).

$$K_{REF(j)}=K_{REF(j)(n-1)}+C_{PREF}\cdot DAF_{ACTL} \quad (8)$$

$$K_{REF(j+1)}=K_{REF(j+1)(n-1)}+C_{PREF}\cdot DAF_{ACTH} \quad (9)$$

After updating compensation coefficients $K_{REF(j)}$ and $K_{REF(j+1)}$ in steps 118 or 119, compensation is applied to the air/fuel ratio feedback compensation coefficient $K_{O2}$ in accordance with the deviations $DAF_{ACTH}$ and $DAF_{ACTL}$, by using equation (10) given below (step 120). Each of the control coefficients $K_j$ and $K_{j+1}$ is then set to 1 (step 121).

$$K_{O2}=K_{O2}-\{C_{PREF}(DAF_{ACTH}+DAF_{ACTL})\}/2 \quad (10)$$

Figure 9:
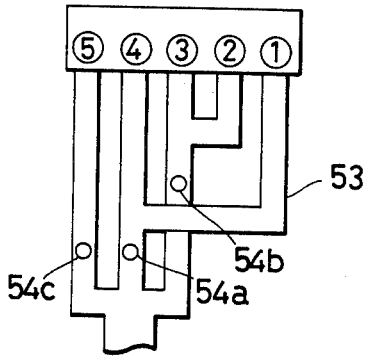
FIGS. 9 through 11 are diagrams showing arrangements of exhaust branch pipes and oxygen concentration sensors for internal combustion engines having respectively different numbers of cylinders.
Figure 10:
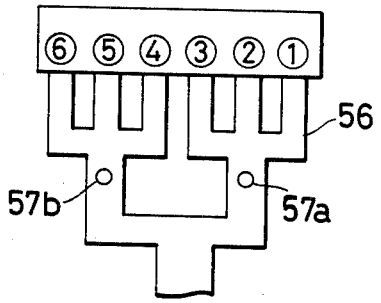
Figure 11:
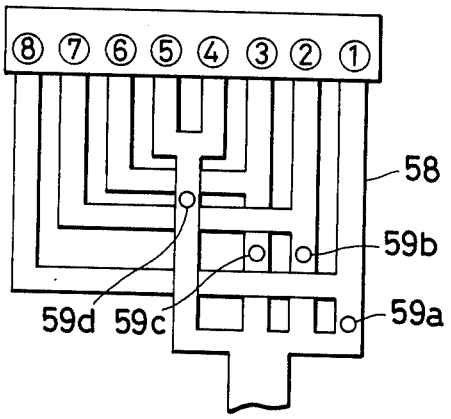

The above embodiment of the present invention has been described for the case of a 4-cylinder internal combustion engine. However the present invention is not limited to this number of cylinders. For example in the case of a 5-cylinder internal combustion engine, if it is assumed that the firing sequence of the cylinders is 1→2→4→5→3, then the exhaust branch pipes 53 can be configured as shown in FIG. 9. Here, an oxygen concentration sensor 54a is provided for the first and the fourth cylinders, oxygen concentration sensor 54b for the second and third cylinders, and oxygen concentration sensor 54c for the fifth cylinder. The compensation coefficients $K_{REF(j)}$ and $K_{REF(j+1)}$ are computed in the same way as for the 4-cylinder engine described above, while $K_{REF}$ for the fifth cylinder is computed on the basis of a single-cylinder engine. In the case of a six-cylinder internal combustion engine, assuming that the firing sequence is 1→5→3→6→2→4, the exhaust branch pipe arrangement 56 shown in FIG. 10 can be utilized. In this system, an oxygen concentration sensor 57a is provided for the first, second and third cylinders, and sensor 57b for the fourth, fifth and sixth cylinders. The compensation coefficients $K_{REF(j)}$ and $K_{REF(j+1)}$ can be respectively computed using j=1, j+1=2, or j=2, j+1=3 in the case of the output from oxygen concentration sensor 57a, and using j=4, j+1=5, or j=5, j+1=6 in the case of the output from oxygen concentration sensor 57b. Similarly, for an 8-cylinder engine, assuming that the firing sequence is 1→5→7→3→8→4→2→6, the exhaust branch pipes 58 can be arranged as shown in FIG. 11. Here, oxygen concentration sensor 59a is provided for the first and eighth cylinders, sensor 59b for the second and seventh cylinders, sensor 59c for the third and the sixth cylinders, and sensor 59d for the fourth and fifth cylinders. In this case the compensation coefficients $K_{REF(j)}$ and $K_{REF(j+1)}$ can be computed from the output of oxygen concentration sensor 59a by using j=1, j+1=8, can be computed from the output of oxygen concentration sensor 59b by using j=2, j+1=7, can be computed from the output of oxygen concentration sensor 59c by using j=3, j+1= 6, and can be computed from the output of oxygen concentration sensor 59d by using j=4, j+1=5. The use of a plurality of sensors with an apparatus according to the present invention as described hereinabove is preferable, in order to prevent interference between the flows of exhaust gas from different cylinders, to thereby improve the effectiveness of sensing the air/fuel ratio of a specific cylinder. However the present invention is equally applicable to the use of a single oxygen concentration sensor used in common for all of the cylinders, i.e. mounted at a position in the exhaust system where the exhaust gas flows from all of the cylinders are combined. In this case, various combinations of j and j+1 can be used to compute values of KREF for the respective cylinders.

With an air/fuel ratio control method according to the present invention, as described hereinabove, during engine operation under a stable condition in which the amount of deviation from a target air/fuel ratio of an air/fuel ratio detected using the output from an oxygen concentration sensor is below a predetermined value, respective compensation values are computed and updated for the individual cylinders in accordance with the magnitude of change in the detected air/fuel ratio. The compensation value thus computed for a specific cylinder is used in controlling the air/fuel ratio of the mixture supplied to that cylinder. In this way, irregularities in the respective values of air/fuel ratio of the mixture actually supplied to different cylinders can be compensated. As a result, improved accuracy of air/fuel ratio control can be obtained, with improved engine performance and enhanced elimination of exhaust pollutants.

What is claimed is:

1. A method of air/fuel ratio control for a multi-cylinder internal combustion engine provided with at least one oxygen concentration sensor mounted within an exhaust system of said internal combustion engine for producing an output which varies substantially in proportion to an oxygen concentration in exhaust gas from said engine, the method comprising:

setting a basic value for airfuel ratio control, in accordance with a plurality of engine operating parameters relating to engine load;

detecting the air/fuel ratio of a mixture supplied to the engine, based upon the output from said oxygen concentration sensor;

compensating said basic value by at least an air/fuel ratio feedback compensation value which is derived in accordance with a deviation from a target air/fuel ratio of an air/fuel ratio detected utilizing the output from said oxygen concentration sensor and by a learning control compensation value representing a secular change of an air/fuel ratio control system including said oxygen concentration sensor and, to thereby determine an output value with respect to said target air/fuel ratio and;

controlling the air/fuel ratio of said mixture in accordance with said output value;

wherein the improvement comprises: detecting a predetermined operating condition of said engine in which variations of said detected air/fuel ratio are small and, computing the updating respective individual values of said learning control compensation value for the respective cylinders of said engine, each said compensation being executed in accordance with the magnitude of a change in said detected air/fuel ratio when said predetermined operating condition is detected.

2. A method of air/fuel ratio control according to claim 1, in which said air/fuel ratio feedback compensation value is a compensation coefficient ($K_{O2}$) by which said basic value is multiplied, and in which said learning control compensation value is a compensation coefficient ($K_{REF}$) by which said basic value is multiplied.

3. A method of air/fuel ratio control according to claim 1, in which said internal combustion engine is provided with a plurality of said oxygen concentration sensors, each of said oxygen concentration sensors being adapted to sense an oxygen concentration in exhaust gas produced from at least one specific corresponding cylinder of said engine.

4. A method of air/fuel ratio control according to claim 1, in which said internal combustion engine is provided with a plurality of said oxygen concentration sensors, each of said oxygen concentration sensors being adaped to sense an oxygen concentration in exhaust gas produced from specific corresponding pair of cylinders of said engine.

5. A method of air/fuel ratio control according to claim 1, in which said predetermined operating condition comprises said deviation from said target air/fuel ratio of said detected air/fuel ratio being smaller than a predetermined value.

6. A method of air/fuel ratio control according to claim 1, in which said predetermined operating condition comprises said deviation from said target air/fuel ratio of a mean value of said detected air/fuel ratio being smaller than a predetermined value.

* * * * *